US008453759B2

(12) United States Patent
Säleniemi

(10) Patent No.: US 8,453,759 B2
(45) Date of Patent: Jun. 4, 2013

(54) METHOD OF DIRECTING DRILLING PATTERN IN CURVED TUNNELS, ROCK DRILLING RIG, AND SOFTWARE PRODUCT

(75) Inventor: Tommi Säleniemi, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 825 days.

(21) Appl. No.: 12/596,491

(22) PCT Filed: Apr. 18, 2008

(86) PCT No.: PCT/FI2008/050204

§ 371 (c)(1),
(2), (4) Date: Oct. 19, 2009

(87) PCT Pub. No.: WO2008/129128

PCT Pub. Date: Oct. 30, 2008

(65) Prior Publication Data

US 2010/0086359 A1 Apr. 8, 2010

(30) Foreign Application Priority Data

Apr. 20, 2007 (FI) ..... 20075279

(51) Int. Cl.
*E21B 7/04* (2006.01)
*B23Q 5/00* (2006.01)

(52) U.S. Cl.
USPC ..... 175/45; 175/61; 173/1; 173/4

(58) Field of Classification Search
USPC ..... 175/45, 40, 61, 24; 173/1, 2, 4
See application file for complete search history.

(56) References Cited

U.S. PATENT DOCUMENTS

| | | | | |
|---|---|---|---|---|
| 4,343,367 | A * | 8/1982 | Mashimo | 173/190 |
| 4,639,868 | A | 1/1987 | Tanaka et al. | |
| 4,698,570 | A * | 10/1987 | Satoh | 318/568.19 |
| 5,139,097 | A * | 8/1992 | Rajala | 175/122 |
| 5,279,372 | A * | 1/1994 | Rinnemaa | 175/24 |
| 6,772,105 | B1 * | 8/2004 | Heck, Sr. | 703/10 |
| 6,934,601 | B2 * | 8/2005 | Hirai et al. | 700/194 |
| 6,957,707 | B2 * | 10/2005 | Koivunen et al. | 175/27 |
| 7,191,060 | B2 * | 3/2007 | Makela | 701/410 |
| 7,477,967 | B2 * | 1/2009 | Makela | 701/23 |

* cited by examiner

*Primary Examiner* — Shane Bomar
*Assistant Examiner* — Catherine Loikith
(74) *Attorney, Agent, or Firm* — Morgan, Lewis & Bockius LLP

(57) ABSTRACT

Method of determining a direction of a drilling pattern in a tunnel curve calculation to be executed in a control unit of a rock drilling rig, a storage device including software product implementing the method and a rock drilling rig. Tunnel line of a tunnel to be excavated is determined. Location of a drilling site on the tunnel line is communicated to the control unit and a navigation plane of the drilling pattern is positioned on the tunnel line. Start point of a round is positioned on the tunnel line and length of the round is provided. End point of the round is positioned at a distance corresponding with the length of the round from the start point and a coordinate system of the drilling pattern is directed so one of its axes points from the start point to the end point. Finally, different coordinate systems are transformed.

21 Claims, 4 Drawing Sheets

37

| A | B | C | D | E |
|---|---|---|---|---|
| depth [m] | x [m] | y [m] | z [m] | G [deg] |
| 0.00 | -30.00 | 0.00 | 0 | -3 |
| 5.00 | -29.58 | 4.98 | 0 | -3 |
| 10.00 | -28.35 | 9.82 | 0 | -3 |
| 15.00 | -26.33 | 14.38 | 0 | -3 |
| 20.00 | -23.58 | 18.55 | 0 | -3 |
| 25.00 | -20.17 | 22.21 | 0 | -3 |
| 30.00 | -16.21 | 25.24 | 0 | -3 |
| 35.00 | -11.80 | 27.58 | 0 | -3 |
| 40.00 | -7.06 | 29.16 | 0 | -2 |
| 45.00 | -2.12 | 29.92 | 0 | -1 |
| 52.12 | 5.00 | 30.00 | 0 | 0 |
| 57.12 | 10.00 | 30.00 | 0 | 0 |
| 62.12 | 15.00 | 30.00 | 0 | 0 |
| 67.12 | 20.00 | 30.00 | 0 | 0 |
| 72.12 | 25.00 | 30.00 | 0 | 2 |
| 74.94 | 27.81 | 30.10 | 0 | 4 |
| 79.94 | 32.80 | 30.16 | 0 | 5 |
| 84.94 | 37.68 | 31.21 | 0 | 5 |
| 89.94 | 42.26 | 33.21 | 0 | 5 |
| 94.94 | 46.34 | 36.08 | 0 | 5 |
| 99.94 | 49.77 | 39.70 | 0 | 5 |
| 104.94 | 52.42 | 43.94 | 0 | 5 |
| 109.94 | 54.17 | 48.61 | 0 | 5 |
| 114.94 | 54.96 | 53.54 | 0 | 5 |
| 119.94 | 54.75 | 58.53 | 0 | 5 |
| 124.94 | 53.56 | 63.37 | 0 | 5 |
| 129.94 | 51.42 | 67.89 | 0 | 5 |
| 134.94 | 48.43 | 71.89 | 0 | 5 |
| 139.94 | 44.71 | 75.21 | 0 | 5 |
| 144.94 | 40.40 | 77.73 | 0 | 5 |

METHOD OF DIRECTING DRILLING PATTERN IN CURVED TUNNELS, ROCK DRILLING RIG, AND SOFTWARE PRODUCT

CROSS REFERENCE TO RELATED APPLICATIONS

This application is the National Stage of International Application No. PCT/FI2008/050204, filed Apr. 18, 2008, and claims benefit of Finnish Application No. 20075279, filed Apr. 20, 2007.

BACKGROUND OF THE INVENTION

The invention relates to a method of determining a direction of a drilling pattern. The invention further relates to a software product and a rock drilling rig. The field of the invention is disclosed in more detail in the preambles of the independent claims of the application.

Usually, tunnels are excavated according to a predetermined tunnel design. The tunnel design determines e.g. the tunnel line of a tunnel to be excavated in the project coordinate system of a tunnel worksite. Further, the tunnel design determines a coordinate system to be used in each case. Since a tunnel is excavated in rounds, a drilling pattern is designed in advance as office work for each round, the drilling pattern determining at least the number, locations, directions and lengths of holes to be drilled. The drilling pattern has a coordinate system of its own which is independent of the project coordinate system of the tunnel worksite. In order for the drilling to be performed, the location and direction of a rock drilling rig is to be determined with respect to the tunnel line and, further, it is necessary to be able to direct the drilling pattern for a new round so that the tunnel progresses in accordance with the designed tunnel line.

In practice, tunnel excavation proceeds such that when the preceding round has been drilled, charged and blasted, broken rock material is transported elsewhere, which is followed by the rock drilling rig being driven to the tunnel face, and navigation. In navigation, the direction of the rock drilling rig is connected with the project coordinate system by means of a tunnel laser whose direction, in turn, has been determined by means of two coordinate points in the project coordinate system, the beam of the tunnel laser passing through these points. Information on the location of the rock drilling rig on the tunnel line may be provided by an operator, e.g. by feeding what is called a peg number. Since the tunnel line is determined in a project coordinate system, since a local site coordinate system is used at the drilling site and, further, since the drilling pattern has its own coordinate system, the project coordinate system and the site coordinate system are to be transformed to the coordinate system of the drilling pattern by means of transformation matrices or the like known per se. Further, when the tunnel to be excavated is curved or when the tunnel laser and the tunnel line are not parallel, an intersection point of the tunnel laser and the drilling pattern as well as hole direction angles are to be calculated in the control unit of the rock drilling rig in connection with each round in order to be able to drill the holes according to the drilling pattern.

In a known curve calculation, the tunnel line is determined by means of a curve table which contains points and their coordinate information, spaced at predetermined distances from one another. The operator communicates the location of the rock drilling rig on the tunnel line, i.e. in practice its distance from the start point of the tunnel, to the control unit, whereafter curve table points nearest to the drilling site are selected, and local coordinate systems are positioned at these points such that the y-axis of each local coordinate system points towards the next point of the curve table. Next, the intersection points of the tunnel laser and the local coordinate systems positioned at the points of curve table are calculated. Further, the coordinates of the intersection point of the tunnel laser and a navigation plane positioned at the drilling site are calculated by interpolating them from the coordinates calculated at the points of the curve table. The coordinates of the intersection point of a plane following the navigation plane are also calculated by interpolating in a similar manner. Subsequently, u and v hole direction angles between the tunnel laser and the navigation plane may be calculated on the basis of the coordinates of the intersection points.

A disadvantage of the present curve calculation is insufficient accuracy. It has been observed that accuracy depends e.g. on the magnitude of an angle formed by the tunnel laser with the tunnel line. This is because large angle values result in mathematical angle errors. Further, accuracy is deteriorated by the fact that the calculation is connected with the distance between the points of the curve table. Additionally, present curve calculation is difficult to understand, which makes tunnel designing and drilling pattern designing more difficult.

BRIEF DESCRIPTION OF THE INVENTION

An object of the present invention is to provide a novel and improved method of directing a drilling pattern in a curved tunnel, a software product implementing the method, and a rock drilling rig.

A method according to the invention is characterized by communicating a length of a round to be drilled to the control unit; determining a shape of the tunnel line over a section of a next round to be drilled; arranging a start point of the drilling pattern on the tunnel line; determining a distance corresponding with the length of the round to be drilled, starting from the start point, and positioning an end point of the round at the particular location on the tunnel line; directing the drilling pattern such that it points from the start point to the end point; and performing coordinate system transformations, taking into account the determined direction of the drilling pattern, and calculating coordinates and directions for holes according to the drilling pattern for drilling.

A rock drilling rig according to the invention is characterized in that execution of a software product downloaded into the control unit is configured to further produce the following procedures: determining a shape of the tunnel line over a section of a next round to be drilled; arranging a start point of the drilling pattern on the tunnel line; determining a distance corresponding with a length of the round to be drilled, starting from the start point, and positioning an end point of the round at the particular location on the tunnel line; directing the drilling pattern such that it points from the start point to the end point; and performing coordinate system transformations, taking into account the determined direction of the drilling pattern, and calculating coordinates and directions for holes according to the drilling pattern for drilling.

A software product according to the invention is characterized in that execution of the software product in the control unit is configured to produce the following procedures: determining a shape of a tunnel line over a section of a next round to be drilled; arranging a start point of the drilling pattern on the tunnel line; determining an end point of the round to be drilled on the tunnel line in response to information on a length of the round and the shape of the tunnel line over the section of the round; directing the drilling pattern such that it points from the start point to the end point; and performing coordinate system transformations, taking into account the determined direction of the drilling pattern.

Further, a second method according to the invention is characterized by determining a shape of the tunnel line over a section of a next round to be drilled in response to information on a length of the round; arranging an origin of the second coordinate system on the tunnel line and determining it as a start point; determining a distance corresponding with the length of the round to be drilled, starting from the start point, and positioning an end point of the round at the particular location on the tunnel line; directing the second coordinate system such that one of its axes points from the start point to the end point; and performing coordinate system transformations from the first coordinate system to the second coordinate system, taking into account the determined direction of the second coordinate system.

An idea underlying the invention is that the rock drilling rig is navigated to the drilling site, and the control unit of the rock drilling rig is informed of the location of the rock drilling rig on the tunnel line, i.e. the start point of a round. Next, the length of the round to be drilled is communicated to the control unit, and the curvature of the tunnel to be excavated is determined over the section of a next round to be drilled. Subsequently, a distance corresponding with the length of the round on the tunnel line is determined, and the end point of the round is positioned at the particular location on the tunnel line. Further, the drilling pattern is directed in the control unit on the basis of the length of the round such that the drilling pattern points from the start point of the round on the tunnel line towards the end point of the round on the tunnel line. Subsequently, coordinate system transformations from a project coordinate system to a coordinate system of the drilling pattern are performed in the control unit by using transformation matrices, for example.

An advantage of the invention is improved accuracy of excavation. Further, the length of a round may be selected as desired. A further advantage is that the possible magnitude of an angle between the tunnel laser and the tunnel line bears no relevance to the accuracy of the calculation. The method according to the invention is also easier to understand, enabling more extensive utilization of the potential of curve calculation by tunnel line and drilling pattern designers. It is also easy for the operator of a rock drilling rig to adopt the curve calculation according to the invention.

An idea of an embodiment is that a local site coordinate system is arranged at the drilling site such that one of its axes points from the start point to the end point, and the direction of the drilling pattern is calculated on the basis of the site coordinate system.

An idea of an embodiment is that the y-axis of the coordinate system of the drilling pattern is directed from the start point to the end point. Correspondingly, if a site coordinate system is used, its y-axis is directed in the drilling direction. A coordinate system layout commonly used in the field is thus applied.

An idea of an embodiment is that a distance is determined from the start point to the end point along the tunnel line of a round to be drilled.

An idea of an embodiment is that a distance is determined from the start point to the end point along the shortest path possible.

An idea of an embodiment is that the local site coordinate system of the drilling site is arranged such that its ys-axis points in the drilling direction. In curve calculation, the ys-axis is directed to point from the start point to the end point. On the basis of this, the direction of the drilling pattern is calculated.

An idea of an embodiment is that navigation is carried out on the basis of a tunnel laser. The tunnel laser emits a beam from which the coordinates of a first laser point A and a second laser point B determined in the project coordinate system are measured. A drilling unit of the rock drilling rig may be provided with two sights, in which case the drilling unit is driven during navigation such that the beam emitted by the tunnel laser passes through both sights. This enables the direction of the rock drilling rig to be connected with the direction of the project coordinate system and, further, on the basis of this information, necessary transformations to be carried out between the coordinate systems. Further, when, in accordance with the invention, the navigation plane is directed from the start point of the round towards the end point determined by the length of the round and the shape of the tunnel line, normal coordinate system transformations from the project coordinate system to the coordinate system of the drilling pattern may subsequently be carried out in the control unit, and the intersection point of the tunnel laser and the navigation plane as well as hole direction angles u and v between the tunnel laser and the navigation plane may be calculated in the control unit. On the basis of this information, the control unit of the rock drilling apparatus is capable of calculating the locations and directions of the holes to be drilled.

An idea of an embodiment is that navigation is carried out on the basis of a tachymeter measurement. In such a case, no tunnel laser is necessary.

An idea of an embodiment is that the tunnel line has been determined in a curve table which has been set up in advance and which contains a plurality of curve table points via which a tunnel line to be formed is to pass. The x-, y- and z-coordinates of the curve table points are determined in the project coordinate system. Further, each point of the curve table is assigned a peg number to describe the depth of a tunnel in xy-plane with respect to a reference point, such as the start point of the tunnel. The control unit is also to be informed as to whether ascending or descending peg numbers are used, i.e. in which direction the tunnel line is viewed as seen from the navigation plane.

An idea of an embodiment is that a curve table is used in curve calculation and a curve table point nearest to the middle point of a round to be drilled is determined and two curve table points nearest to this middle point of the curve table are determined. Next, the curvature of the tunnel is approximated at the round to be drilled by determining in the control unit a curve whose descriptor in the best way passes via said three curve table points. Further, the drilling pattern, i.e. in practice the navigation plane, is directed at the drilling site such that taking the length of the round into account, the y-axis of the coordinate system of the drilling pattern points towards the end point of the round which resides on the approximated curve.

An idea of an embodiment is that points are determined in a curve table spaced at a different distance from one another. In such a case, for instance, the distance between the points of the curve table may be determined to be smaller in sections over which the curved portion of the tunnel line becomes a straight one, or vice versa, as compared to that in the other sections. Further, when the radius of curvature changes in a curved tunnel, points of the curve table may be determined to be spaced more densely. This enables the accuracy of calculation to be improved.

An idea of an embodiment is that instead of using curve table points, the tunnel line is determined by expressing the central line of a tunnel as a mathematical equation. A mathematical function describing a tunnel line may be set up in advance as office work by utilizing a tunnel design program. A continuous mathematical function describing a tunnel line may be an equation of an arc of a circle, for instance. This application may improve the accuracy particularly when drilling a steep curve.

An idea of an embodiment is that the operator feeds the location of the drilling site through a user interface of the control unit. On the basis of the information provided, the control unit positions the navigation plane and the start point of the round on the tunnel line.

An idea of an embodiment is that the location of the drilling site is measured and measurement information is communicated to the control unit. The control unit positions the navigation plane and the start point of the round at the measured location on the tunnel line. The measurement may be carried out by means of e.g. a tachymeter or another appropriate measuring device.

An idea of an embodiment is that the operator feeds the length of the round to the user interface of the control unit.

An idea of an embodiment is that the length of the round is determined in the drilling pattern so that it is taken into account already while downloading the drilling pattern into the control unit.

An idea of an embodiment is that the drilling pattern is inclined by a magnitude of a predetermined inclination angle. Inclination angles of the tunnel line may be determined e.g. in the curve table at each point separately. If the inclination angle differs from zero, the coordinate system of the drilling pattern is inclined by a magnitude of an inclination angle determined around a straight line parallel with its yd-axis, which results in the yd-axis of the drilling pattern still pointing to the end point of the round but the directions of the xd-axis and the zd-axis of the drilling pattern being changed by the magnitude of the inclination angle. The influence of the inclination angle is taken into account in the transformation matrices of the coordinate systems.

An idea of an embodiment is that a pivot point is determined in advance to determine the position of the coordinate system of the drilling pattern with respect to the site coordinate system. The coordinates of the pivot point are determined in the coordinate system of the drilling site and in the coordinate system of the drilling pattern.

An idea of an embodiment is that inclination angles are determined for the tunnel line and, further, the position of the coordinate system of the drilling pattern with respect to the site coordinate system is determined by means of the pivot point. In such a case, the coordinate system of the drilling pattern is inclined around a straight line which passes via the pivot point and which is parallel with the y-axis of the coordinate system of the drilling pattern.

An idea of an embodiment is that substantially all procedures associated with directioning the drilling pattern are executed in the control unit of the rock drilling rig.

An idea of an embodiment is that at least one of the procedures associated with directing the drilling pattern is executed in one or more control units external to the rock drilling rig. In such a case, information associated with directing the drilling pattern is communicated via a datacommunication connection between the control unit of the rock drilling rig and a control unit located e.g. in a control room of a mine.

An idea of an embodiment is that directing the drilling pattern is performed by a planning computer or a corresponding control unit used for providing the tunnel design or the drilling pattern. This enables the designer to simulate drilling plans or the like, if desired.

An idea of an embodiment is that in order to direct the drilling pattern, a software product is downloaded from storage or memory means, such as a memory stick, memory disk, hard disk, information network server or the like, into the control unit of the rock drilling rig, the execution of the software product in the control unit producing procedures described in the present application.

BRIEF DESCRIPTION OF THE FIGURES

Some embodiments of the invention are described in closer detail in the accompanying drawings, in which.

For the sake of clarity, the figures show some embodiments of the invention in a simplified manner. In the figures, like reference numerals identify like elements.

DETAILED DESCRIPTION OF SOME EMBODIMENTS OF THE INVENTION

Figure 1:
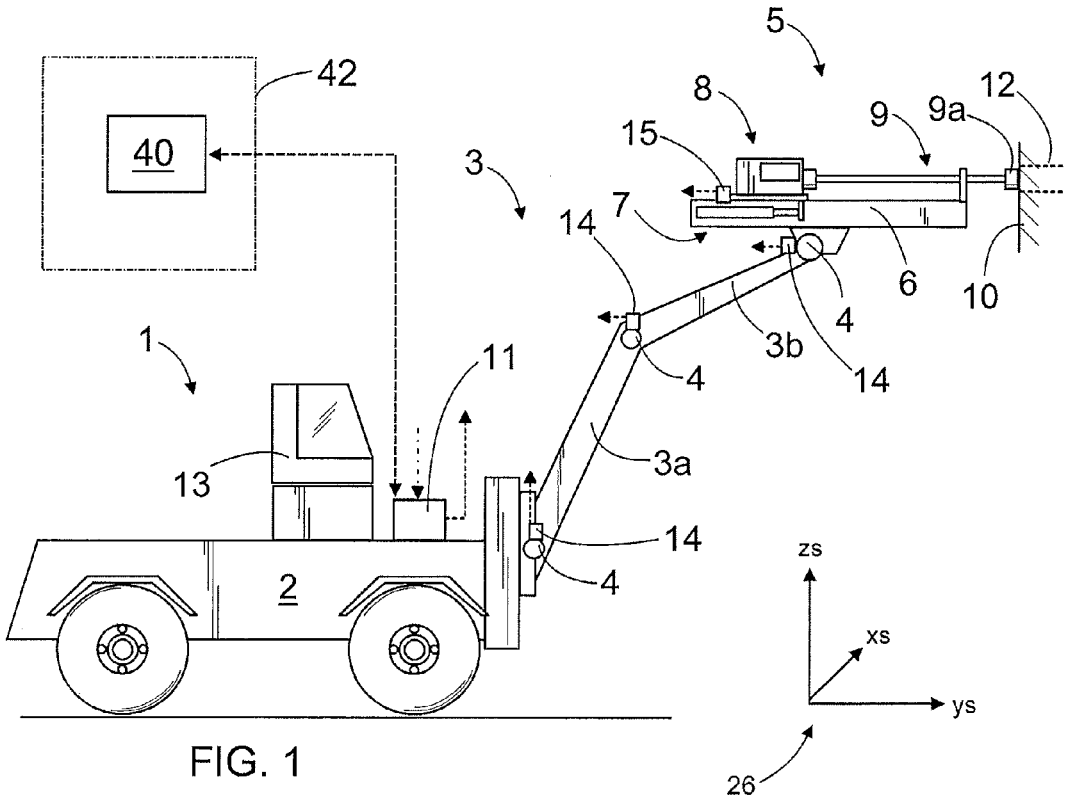
FIG. 1 is a schematic side view showing a rock drilling rig positioned at a tunnel face for drilling, FIGS. 2*a* and 2*b* schematically and as seen in xy-plane show a curved tunnel, coordinate systems used in connection therewith, and a navigation arrangement for a rock drilling rig at a drilling site, FIG. 3 schematically and as seen in xy-plane shows a solution according to the invention for directing a drilling pattern from a start point located on a navigation plane to an end point of a round located on a tunnel line, FIG. 4 schematically shows a transformation from a project coordinate system to a site coordinate system of a drilling site and further to a coordinate system of a drilling pattern, as well as transfer and inclination of the coordinate system of the drilling pattern with respect to a predetermined pivot point, FIG. 5 schematically and as seen in xy-plane shows a way to approximate a curved tunnel line on the basis of three curve table points.

A rock drilling rig 1 shown in FIG. 1 comprises a movable carrier 2 provided with one or more drilling booms 3. The drilling boom 3 may consist of one or more boom parts 3*a*, 3*b* that may be engaged with one another and with the carrier 2 by articulations 4 so that the booms 3 may be moved in a versatile manner in different directions. Further, a free end of each drilling boom 3 may be provided with a drilling unit 5 which may comprise a feed beam 6, a feed device 7, a rock drill machine 8, as well as a tool 9 whose outer end may be provided with a drill bit 9*a*. The rock drill machine 8 may be moved by means of the feed device 7 with respect to the feed beam 6 so as to enable the tool 9 to be fed towards rock 10 during drilling. The rock drill machine 8 may comprise a percussion device for delivering stress pulses on the tool 9, and further, a rotating device for rotating the tool 9 about its longitudinal axis. The rock drilling rig 1 may further comprise one or more control units 11 for controlling the drilling. The control unit 11 may comprise one or more processors, a programmable logic or a similar device for executing a software product whose execution produces a method according to the invention. In addition, the control unit 11 may be provided with a drilling pattern determining at least the locations and directions of holes 12 to be drilled. The control unit 11 further comprises a display device located at a drilling platform of the rock drilling rig 1 or in a control cabin 13. The display device enables information necessary for drilling and positioning to be displayed to an operator who, through a user interface of the display device, may give commands and feed information to the control unit 11. The control unit 11 may give commands to actuators moving the drilling boom 3, the feed device 7 as well as to other actuators influencing the position of the drilling unit 5. Further, one or more sensors 14 may be provided in connection with the articulations 4 of the drilling boom 3, and one or more sensors 15 may be provided in connection with the drilling unit 5. Measurement information obtained from the sensors 14, 15 may be conveyed to the control unit 11 which, on the basis of the measurement information, may determine the location and direction of the drilling unit 5 for control. Furthermore, the processor of the control unit 11 is provided with a calculation unit which is capable of executing coordinate system transformation matrices as well as e.g. calculations necessary for navigation and positioning of the drilling unit. In FIG. 1, the control unit 11 has positioned the drilling unit 5 at the hole 12 to be drilled after the locations and directions of the holes according to the drilling pattern have been calculated and the necessary coordinate system transformations have been performed.

Figures 2A, 2B:
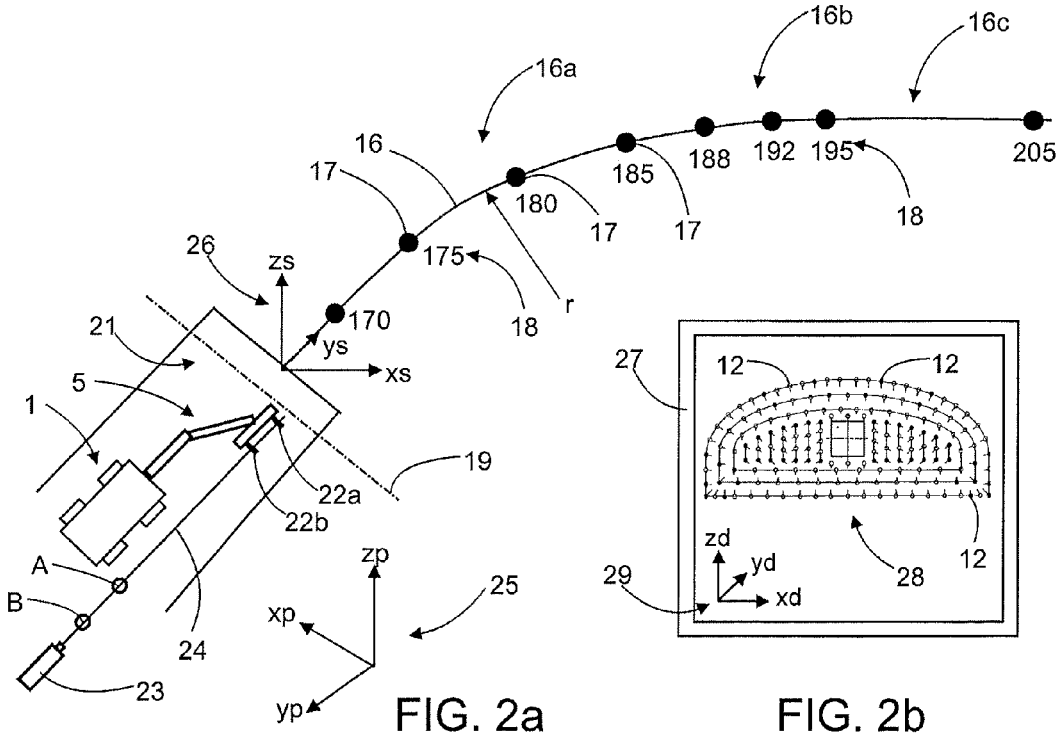
Figures 5, 6:
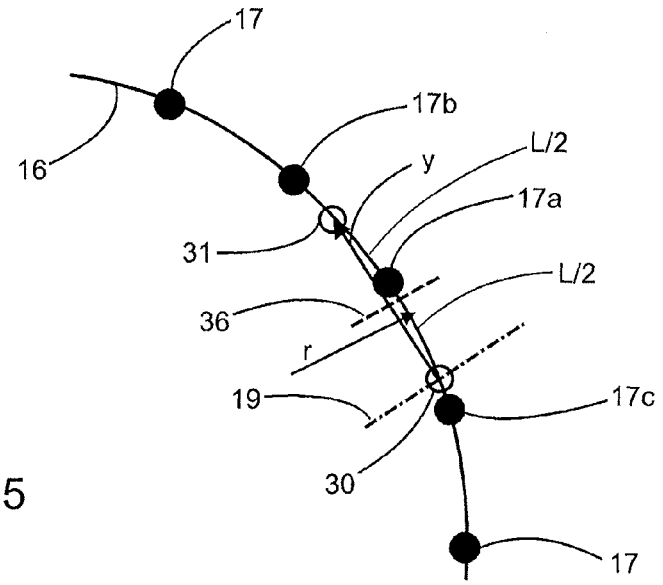
FIG. 6 shows a curve table determining peg numbers, point coordinates, and inclinations.

FIG. 2*a* shows a curved tunnel line 16, which may be determined by means of points 17 of the curve table or in another manner, e.g. as mathematical equations. When a curve table is used, the tunnel line 16 passes via the points 17. When designing a tunnel, the coordinates of the points 17, peg numbers 18 as well as inclinations are determined in the curve table, as can be seen in FIG. 6 below. The points 17 of the curve table are located along the tunnel line 16 at a determined distance from one another such that each point 17 is provided with a peg number 18 of its own. The peg number 18 thus indicates the depth of the tunnel at a certain location, starting from a reference point. The peg number 18 may be given e.g. in meters, starting from the start point of the tunnel. The operator of the rock drilling rig 1 may communicate the peg number 18 to the control unit 11 so that the control unit knows how far the tunnel drilling has progressed. The peg number 18 enables the location of a navigation plane 19 in direction xz to be determined on the tunnel line 16. Further, the control unit 11 is informed about whether the peg number 18 is ascending or descending so as to enable the control unit 11 to know the direction in which the tunnel line 16 is to be viewed as seen from the navigation plane 19. A drilling pattern 28 (seen in FIG. 2*b*) is positioned on the navigation plane 19. The accuracy of curve calculation is influenced e.g. by the distance between the points 17 of the curve table. The accuracy of curve calculation may thus be improved by spacing points 17 of the curve table more densely at desired locations, since in the solution according to the invention, the points 17 of the curve table do not necessarily have to be spaced at equal distances from one another. The curve table may be provided with points 17 spaced more densely e.g. at a location 16*b* where an evenly curved section 16*a* of the tunnel becomes a straight one 16*c*, and vice versa, or at locations where the radius of curvature r of the tunnel changes abruptly.

It is to be noted that a tunnel is curved if three selected points arranged on its central line do not reside on the same line. Prior to curve calculation, a software product to be executed in the control unit 11 may test whether a tunnel section is a straight one 16*c* or a curved one 16*a*, 16*b*. If the tunnel section is a curved one, the solution described in the present application may be utilized. In connection with straight sections, interpolation may be used.

In FIG. 2*a*, the rock drilling rig 1 has been driven to a tunnel face 21 for navigation. For navigation, one drilling unit 5 of the rock drilling rig 1 may be equipped with two sights 22*a* and 22*b*, in which case the drilling unit 5 is driven at the drilling site such that a beam 24 of a tunnel laser 23 which has been directed in advance passes through the sights. Coordinates have been determined in the tunnel design for a first laser point A and a second laser point B, which determine the direction of the tunnel laser 23. When the drilling unit of the rock drilling rig has been positioned in a position to enable the beam emitted by the tunnel laser to pass through the sights, the control unit 11 may determine the direction of the rock drilling rig 1 with respect to a project coordinate system 25 wherein the direction of the tunnel laser 23 has been determined. Further, the operator may provide the location of the navigation plane 19 on the tunnel line or the location of the navigation plane 19 may be measured. On the basis of this information, coordinate system transformations may be carried out.

FIG. 2*a* further shows coordinate systems to be used in tunnel excavation. Coordinate systems and their mutual relationships defined in International Rock Excavation Data Exchange Standard (IREDES) may be applied to the present application. In the project coordinate system 25, the tunnel line 16 and the laser points A and B are defined by means of xp-, yp-, and zp-coordinates. Further, a local "site coordinate system" 26 with xs-, ys-, and zs-axes is used at the drilling site such that its ys-axis points in the drilling direction. FIG. 2*b* still further shows a drilling pattern 28 on a display device 27 of the control unit 11, where the drilling pattern 28 is provided with a coordinate system 29 of its own, together with its xd-, yd-, and zd-axes.

Figure 3:
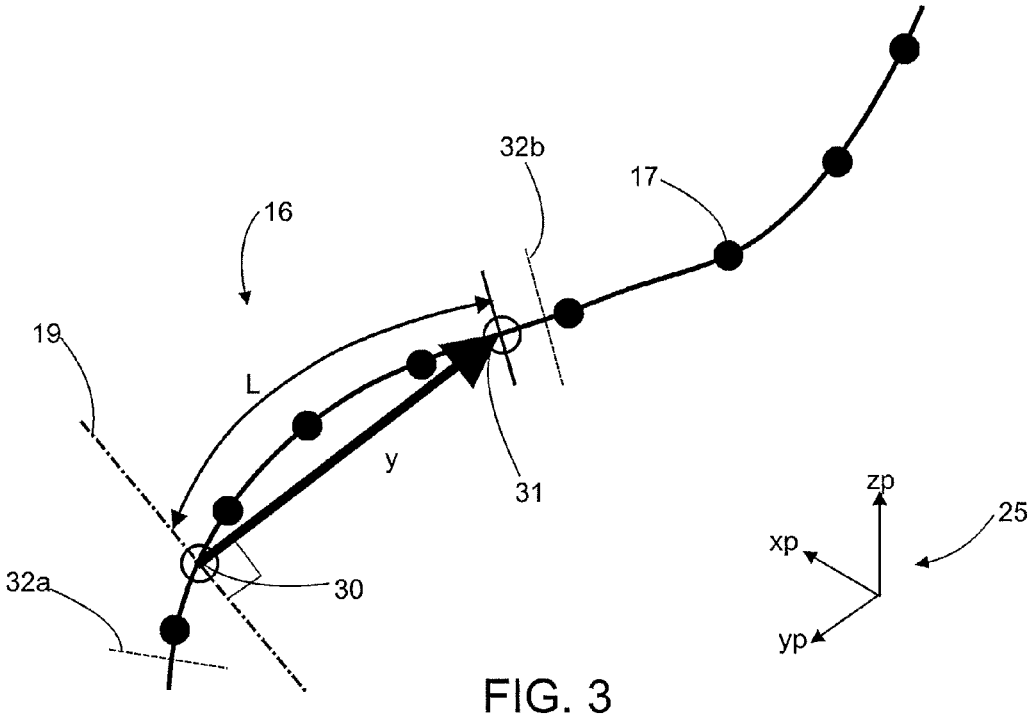
Figure 4:
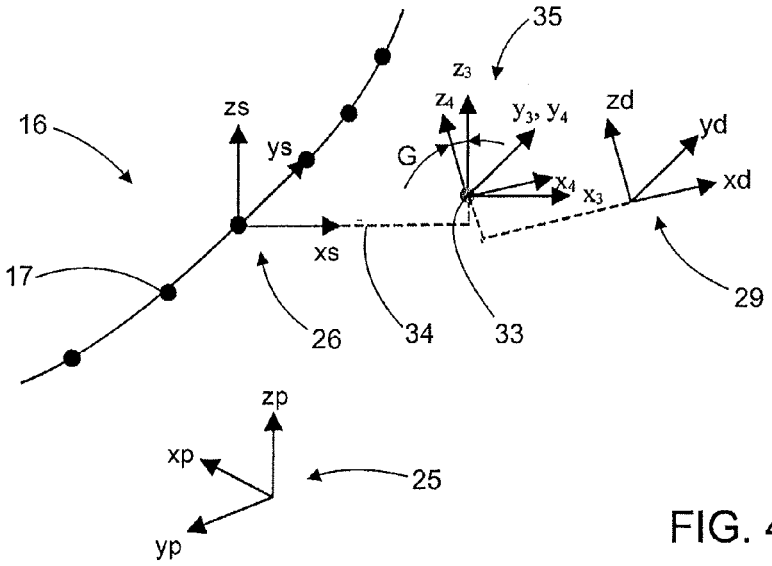

FIG. 3 shows, as seen in xy-plane, directioning of the drilling pattern 28. The ys-axis of the site coordinate system 26 is directed to point from a start point 30 located on the navigation plane 19 to an end point 31 of a round located on the tunnel line 16. On the basis of the directioning of the site coordinate system, the curve calculation carries out the necessary transformation calculations and directs the drilling pattern 28 for drilling. For directioning, the operator, through the user interface of the control unit 11, feeds a length L of the round to be drilled or, alternatively, the length L is indicated otherwise, e.g. in the drilling pattern 28. The location of the end point 31 is determined on the basis of the curvature of the tunnel line 16 and the length L of the round. The shape of the tunnel line 16 may be approximated by what is called curve fitting, i.e. by arranging a curve to pass via the points 17 of the curve table, or, alternatively, the shape of the tunnel line 16 may already have been given as mathematical functions for different sections of the tunnel line 16. For the sake of example, FIG. 3 shows lines 32*a* and 32*b* wherein the curved tunnel line therebetween may be determined as a continuous mathematical function, e.g. as an equation of an arc of a circle with a given radius. In such a case, the control unit 11 knows where the tunnel line 16 goes and is capable of positioning the end point 31 of a round to be drilled next at a distance corresponding with the length L of the round from the start point, as defined along the tunnel line 16. Next, the site coordinate system 26 is directed in the control unit 11 such that the ys-axis points from the start point 30 to the end point 31. When the new direction of the coordinate system 29 of the drilling pattern is calculated and the coordinate system is directed, the direction of the navigation plane 19 changes as well. FIG. 4 illustrates coordinate systems to be used in curve calculation and transformations associated therewith. The coordinate systems and transformation matrices to be used in their transformations are defined in International Rock Excavation Data Exchange Standard (IREDES), which is incorporated herein by reference. The curve calculation to be executed in the control unit of the rock drilling rig calculates the dependencies between different coordinate systems. The curve calculation calculates the trans-formation matrices from the project coordinate system 25 to the site coordinate system 26 and further to the coordinate system 29 of the drilling pattern. Furthermore, if the navigation is carried out by means of a tunnel laser 23, the curve calculation calculates the intersection point of the tunnel laser and the drilling pattern 28 as well as direction angles therebetween. In some cases, however, navigation may also be carried out in a different manner. Even in such a case, different coordinate systems are transformed taking the navigation results into account.

FIG. 4 shows the principle of what is called a pivot point 33. The pivot point 33 determines the location of the coordinate system 29 of the drilling pattern with respect to the site coordinate system 26. The coordinates of the pivot point 33 are determined both in the site coordinate system 26 of the drilling site and in the coordinate system 29 of the drilling pattern. By means of the pivot point 33 and the inclination angle G, a transformation 34 in xz-plane may be performed from the site coordinate system 26 to the coordinate system 29 of the drilling pattern, which gives a coordinate system according to coordinate axes xd, yd, and zd shown in FIG. 4. If inclination angles G are determined for the tunnel line 16, the coordinate system 29 of the drilling pattern may be inclined in phase 35 around a straight line which passes via the pivot point 33 and which is parallel with the yd-axis of the coordinate system 29 of the drilling pattern. Irrespective of the inclination, the coordinates of the pivot point 33 remain constant in the site coordinate system 26 and in the coordinate system 29 of the drilling pattern. FIG. 4 shows an inclination 35 whereby the coordinate system defined by axes x3, y3, and z3 rotates counter-clockwise by the magnitude of the inclination angle G, into a coordinate system defined by axes x4, y4, and z4. The end result is the coordinate system 29 of the drilling pattern, which has been modified in the control unit 11 with respect to the pivot point 33.

FIG. 5 illustrates approximation of the shape of a tunnel line 16 by using a method called curve fitting. As already stated above, the tunnel line 16 may be determined in a curve table. A round to be drilled is given a length L. In addition, the location of the start point, i.e. the peg number, is given, which enables a point 17*a* of the curve table nearest to the centre 36 of the round as well as two points 17*b* and 17*c* of the curve table nearest to this middle point 17*a* of the curve table to be determined. Next, the curvature of the tunnel line 16 is approximated at the round to be drilled by determining, in the control unit 11, a curve whose descriptor in the best way passes via said three points 17*a*, 17*b*, 17*c* of the curve table. Typically, a curve is an arc of a circle with a situation-dependent radius r. The control unit 11 may be provided with a data file of various curve equations that may be applied. Further, the drilling pattern 28 is directed at the drilling site, i.e. in practice the navigation plane 19 is placed such that taking the length L of the round into account, the yd-axis of the coordinate system of the drilling pattern points towards the end point 31 of the round residing on the approximated curve.

FIG. 6 shows a curve table 37 wherein column A determines the peg numbers of points in metres, column B determines the x-coordinates of the points in metres, column C determines the y-coordinates of the points in metres, column D determines the z-coordinates of the points in metres and, further, column E determines the inclination angle in degrees. The coordinates of a possible pivot point are curve table specific constants, so they do not have to be presented as separate columns.

The inclination angle G enables the coordinate system of the drilling pattern to be inclined around a straight line parallel with the y-axis. Even if the inclination angle were zero, the coordinate system of the drilling pattern may still have been inclined around a straight line parallel with the x-axis. In such a case, the tunnel includes an uphill or a downhill. An inclination around a straight line parallel with the x-axis is determined on the basis of a difference of height between the points of the curve table.

Figure 7:
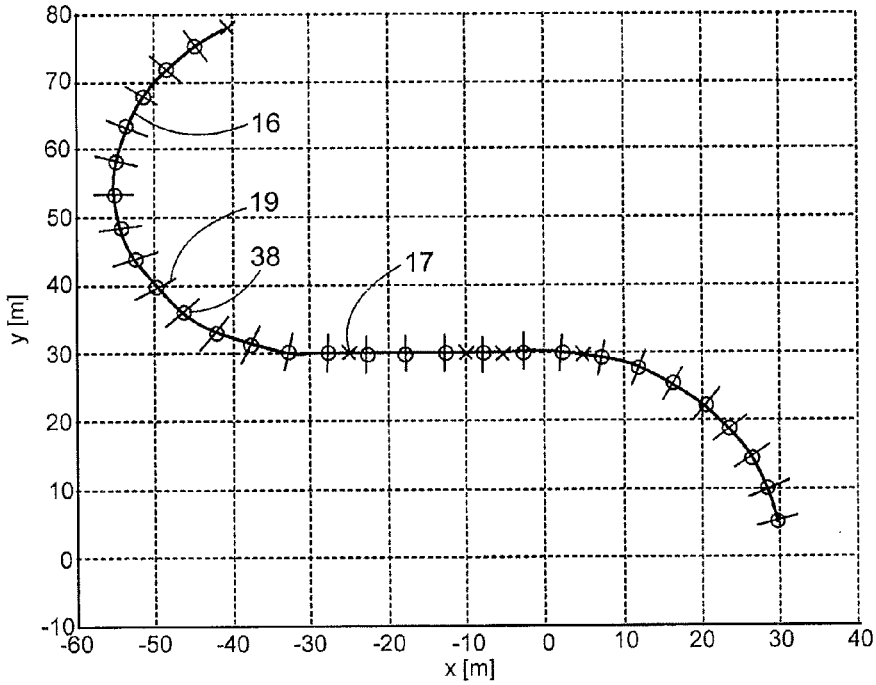
FIG. 7 shows a tunnel line of the curve table according to FIG. 6 as seen in xy-plane and provided with navigation planes directed according to round lengths.
Figure 8:
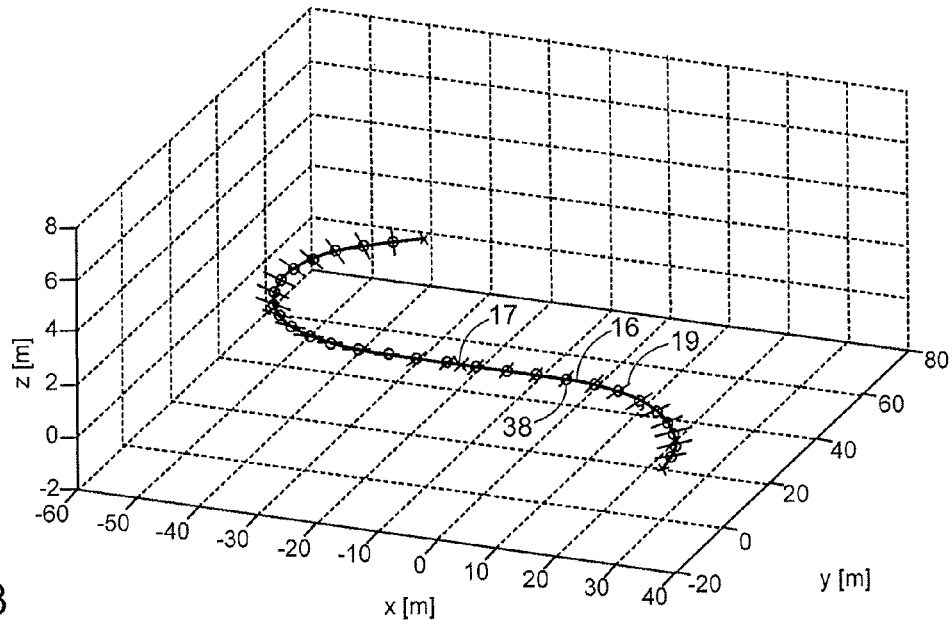
FIG. 8 shows the tunnel line of the curve table according to FIG. 6 three-dimensionally, enabling also the inclinations determined in the curve table to be seen from the positions of the transverse lines depicting the navigation planes.

FIG. 7 shows a tunnel line of the curve table 37 according to FIG. 6 as seen in xy-plane and provided with navigation planes directed according to the length of a round. In FIG. 7, the asterisks on the tunnel line 16 depict the points 17 of the curve table, circles 38 depict the start and end points and, further, transverse lines 19 across the tunnel line depict the navigation planes. Similarly, FIG. 8 shows the tunnel line 16 of the curve table 37 according to FIG. 6 three-dimensionally, enabling also the inclinations G determined in the curve table to be seen from the positions of the transverse lines 19 depicting the navigation planes.

Unlike in the curve table 37 shown in FIG. 6, the points 17 may also be given coordinates in the z direction. This enables the tunnel line 16 to be viewed also as a projection of the z-axis and the peg number, i.e. as a height curve. The curvature of the height curve at a round to be drilled next may be approximated in a manner similar to that described in connection with the xy-projection above and, further, the directioning of the coordinate system 29 of the drilling pattern may be carried out in a manner similar to that described above.

FIG. 1 still further shows an external control unit 40 to enable execution of one or more procedures associated with the directioning of a drilling pattern, such as calculation associated with coordinate system trans-formation or other data processing. It is possible that substantially all procedures associated with directioning are executed in such a control unit 40, which may reside e.g. in a control room 42, and the complete drilling pattern direction information is communicated to the control unit 11 of the rock drilling rig. Information may be communicated between the control units 11 and 40 via a datacommunication connection, which may be wireless.

It is further to be noted that instead of the y-axis, it is possible to direct another axis of the site coordinate system in the drilling direction and, on the other hand, an axis of the drilling pattern other than the y-axis may be directed from the start point to the end point. In such a case, it is a matter of naming the coordinate systems and their axes. Further, it is possible that no site coordinate system is used at all. In such a case, the project coordinate system and the coordinate system of the drilling pattern are transformed directly with no calculation via the site coordinate system. The coordinate systems may also be named differently from those disclosed above.

It may further be possible that the drilling pattern determines no navigation plane; the aim is then only to enable the coordinate system of the drilling pattern to be directed utilizing the idea of the invention.

In some cases, the features disclosed in the present application may be used as such, irrespective of other features. On the other hand, when necessary, the features disclosed in the present invention may be combined so as to provide different combinations.

The drawings and the related description are only intended to illustrate the idea of the invention. In its details, the invention may vary within the scope of the claims.

The invention claimed is:

1. A method of determining a direction of a drilling pattern, the method comprising:

downloading into a control unit a tunnel line of a tunnel to be excavated, the tunnel line being determined in a project coordinate system of a tunnel worksite;

downloading into the control unit a drilling pattern determining at least a navigation plane and a coordinate system of the drilling pattern;

determining a drilling site for the control unit and arranging a local coordinate system at the drilling site such that one of its axes points in a drilling direction;

positioning the navigation plane of the drilling pattern at the drilling site;

positioning a rock drilling rig at the drilling site and connecting the coordinate systems with one another by navigation;

performing necessary coordinate system transformations from the project coordinate system to the coordinate system of the drilling pattern;

communicating a length of a round to be drilled to the control unit;

determining a shape of the tunnel line over a section of a next round to be drilled;

arranging a start point of the drilling pattern on the tunnel line;

determining a distance corresponding with the length of the round to be drilled, starting from the start point, and positioning an end point of the round at the particular location of the tunnel line;

directing the drilling pattern such that it points from the start point to the end point; and performing coordinate system transformations, taking into account the determined direction of the drilling pattern, and calculating coordinates and directions for holes according to the drilling pattern for drilling, wherein the tunnel line is predetermined and the method further comprises using the predetermined tunnel line to determine a direction of each of a plurality of successive rounds.

2. The method as claimed in claim 1 comprising arranging a local site coordinate system at the drilling site such that one of its axes points from the start point to the end point, and calculating, on the basis of the site coordinate system, the direction of the drilling pattern.

3. The method as claimed in claim 1 comprising determining a distance from the start point to the end point along the tunnel line of the round to be drilled.

4. The method as claimed in claim 1, comprising:

determining in advance the curvature of the tunnel line as at least one mathematical function;

communicating the mathematical function describing the tunnel line to the control unit; and directing, in the control unit, the drilling pattern such that one of the axes of the coordinate system of the drilling pattern points towards the end point of the round on the tunnel line defined by the mathematical function and at a distance from the start point of the round corresponding with the length of the round.

5. The method as claimed in claim 1, comprising feeding a position of the drilling site on the tunnel line to the control unit by an operator through a user interface; and positioning the navigation plane and the start point of the round at a location on the tunnel line indicated by the operator.

6. The method as claimed in claim 1, comprising:

measuring the location of the drilling site and communicating measurement information to the control unit; and positioning the navigation plane and the start point of the round at the measured location on the tunnel line.

7. The method as claimed in claim 1, comprising feeding the length of the round to the control unit by the operator through the user interface.

8. The method as claimed in claim 1, comprising determining the length of the round in the drilling pattern and taking it into account while downloading the drilling pattern into the control unit.

9. The method as claimed in claim 1, comprising:

determining inclination angles for the tunnel line in the project coordinate system;

inclining the coordinate system of the drilling pattern by a magnitude of the determined inclination angle around a straight line parallel with yd-axis of the drilling pattern, which results in the yd-axis of the drilling pattern still pointing to the end point of the round but directions of xd-axis and zd-axis of the drilling pattern being changed by the magnitude of the inclination angle; and taking into account influence of the inclination of the drilling pattern while transforming the coordinate systems.

10. The method as claimed in claim 1, comprising:

determining inclination angles for the tunnel line in the project coordinate system;

determining a pivot point together with its coordinates in the site coordinate system of the drilling site and in the coordinate system of the drilling pattern; and inclining the coordinate system of the drilling pattern by a magnitude of an inclination angle determined around a straight line which passes via the pivot point and which is parallel with the yd-axis of the coordinate system of the drilling pattern.

11. The method as claimed in claim 1, comprising executing procedures associated with directing the drilling pattern in the control unit of the rock drilling rig.

12. The method as claimed in claim 1, comprising:

executing at least one of the procedures associated with directing the drilling pattern in at least one control unit external to the rock drilling rig; and communicating information associated with directing the drilling pattern between the control units via a datacommunication connection.

13. The method as claimed in claim 1, comprising executing the procedures associated with directing the drilling pattern on a tunnel design computer.

14. A method of determining a direction of a drilling pattern, the method comprising:

downloading into a control unit a tunnel line of a tunnel to be excavated, the tunnel line being determined in a project coordinate system of a tunnel worksite;

downloading into the control unit a drilling pattern determining at least a navigation plane and a coordinate system of the drilling pattern;

determining a drilling site for the control unit and arranging a local coordinate system at the drilling site such that one of its axes points in a drilling direction;

positioning the navigation plane of the drilling pattern at the drilling site;

positioning a rock drilling rig at the drilling site and connecting the coordinate systems with one another by navigation;

performing necessary coordinate system transformations from the project coordinate system to the coordinate system of the drilling pattern;

communicating a length of a round to be drilled to the control unit;

determining a shape of the tunnel line over a section of a next round to be drilled;

arranging a start point of the drilling pattern on the tunnel line;

determining a distance corresponding with the length of the round to be drilled, starting from the start point, and positioning an end point of the round at the particular location of the tunnel line;

directing the drilling pattern such that it points from the start point to the end point;

performing coordinate system transformations, taking into account the determined direction of the drilling pattern, and calculating coordinates and directions for holes according to the drilling pattern for drilling;

determining the tunnel line by means of a curve table comprising a plurality of points via which the tunnel line passes;

determining for the points of the curve table at least x-, y-, z-coordinates in the project coordinate system and for each point a peg number of its own which describes a depth of the tunnel at the point with respect to a reference point and as viewed in xy-plane;

determining a point of the curve table nearest to a centre of the round to be drilled, and determining two points of the curve table nearest to this middle point of the curve table;

approximating curvature of the tunnel at the round to be drilled by determining, in the control unit a curve equation whose descriptor in the best way passes via said three points of the curve table;

positioning the end point of the round on the curve approximating the curvature of the tunnel line and at a distance from the start point of the round corresponding with the length of the round as defined along the tunnel line; and directing, in the control unit, the drilling pattern such that it points from the start point towards the end point of the round.

15. A method of determining a direction of a drilling pattern, the method comprising:

downloading into a control unit a tunnel line of a tunnel to be excavated, the tunnel line being determined in a project coordinate system of a tunnel worksite;

downloading into the control unit a drilling pattern determining at least a navigation plane and a coordinate system of the drilling pattern;

determining a drilling site for the control unit and arranging a local coordinate system at the drilling site such that one of its axes points in a drilling direction;

positioning the navigation plane of the drilling pattern at the drilling site;

positioning a rock drilling rig at the drilling site and connecting the coordinate systems with one another by navigation;

performing necessary coordinate system transformations from the project coordinate system to the coordinate system of the drilling pattern;

communicating a length of a round to be drilled to the control unit;

determining a shape of the tunnel line over a section of a next round to be drilled;

arranging a start point of the drilling pattern on the tunnel line;

determining a distance corresponding with the length of the round to be drilled, starting from the start point, and positioning an end point of the round at the particular location of the tunnel line;

directing the drilling pattern such that it points from the start point to the end point;

performing coordinate system transformations, taking into account the determined direction of the drilling pattern, and calculating coordinates and directions for holes according to the drilling pattern for drilling;

determining a tunnel laser in the project coordinate system;

navigating the rock drilling rig at the drilling site by means of the tunnel laser; and performing, in the control unit, coordinate system transformations and determining an intersection point of the tunnel laser and the navigation plane as well as direction angles of the tunnel laser with respect to the navigation plane.

16. A method of determining a direction of a drilling pattern, the method comprising:

downloading into a control unit a tunnel line of a tunnel to be excavated, the tunnel line being determined in a project coordinate system of a tunnel worksite;

downloading into the control unit a drilling pattern determining at least a navigation plane and a coordinate system of the drilling pattern;

determining a drilling site for the control unit and arranging a local coordinate system at the drilling site such that one of its axes points in a drilling direction;

positioning the navigation plane of the drilling pattern at the drilling site;

positioning a rock drilling rig at the drilling site and connecting the coordinate systems with one another by navigation;

performing necessary coordinate system transformations from the project coordinate system to the coordinate system of the drilling pattern;

communicating a length of a round to be drilled to the control unit;

determining a shape of the tunnel line over a section of a next round to be drilled;

arranging a start point of the drilling pattern on the tunnel line;

determining a distance corresponding with the length of the round to be drilled, starting from the start point, and positioning an end point of the round at the particular location of the tunnel line;

directing the drilling pattern such that it points from the start point to the end point;

performing coordinate system transformations, taking into account the determined direction of the drilling pattern, and calculating coordinates and directions for holes according to the drilling pattern for drilling;

determining a pivot point together with its coordinates in the site coordinate system of the drilling site and in the coordinate system of the drilling pattern;

determining a position of the coordinate system of the drilling pattern with respect to the site coordinate system by means of the pivot point; and taking into account influence of the pivot point while transforming the coordinate systems.

17. A rock drilling rig, comprising:

a movable carrier;

at least one drilling boom and at least one drilling unit which comprises a feed beam arranged in the drilling boom, a rock drill machine movable by means of a feed device with respect to the feed beam, and a tool connectable with the rock drill machine;

at least one sensor for determining a position and direction of the drilling unit; and at least one control unit enabling execution of a curve calculation program whose execution produces the following procedures:

downloading into a control unit a tunnel line of a tunnel to be excavated, the tunnel line being determined in a project coordinate system of a tunnel worksite, downloading into the control unit a drilling pattern determining at least a navigation plane and a coordinate system of the drilling pattern, determining a drilling site for the control unit and arranging a local coordinate system at the drilling site such that one of its axes points in a drilling direction, positioning the navigation plane of the drilling pattern at the drilling site, taking into account positioning of the rock drilling rig at the drilling site and connecting the coordinate systems with one another by navigation, and performing necessary coordinate system transformations from the project coordinate system to the coordinate system of the drilling pattern, wherein execution of a software product downloaded into the control unit is configured to further produce the following procedures:

determining a shape of the tunnel line over a section of a next round to be drilled, arranging a start point of the drilling pattern on the tunnel line;

determining a distance corresponding with a length of the round to be drilled, starting from the start point, and positioning an end point of the round at the particular location on the tunnel line, directing the drilling pattern such that it points from the start point to the end point, and performing coordinate system transformations, taking into account the determined direction of the drilling pattern, and calculating coordinates and directions for holes according to the drilling pattern for drilling, wherein the tunnel line is predetermined and the procedures further comprise using the predetermined tunnel line to determine a direction of each of a plurality of successive rounds.

18. A storage device including a software product for determining a direction of a drilling pattern of a rock drilling rig in a control unit, wherein execution of the software product in the control unit is configured to produce the following procedures:

determining a shape of a tunnel line over a section of a next round to be drilled, arranging a start point of the drilling pattern on the tunnel line, determining an end point of the round to be drilled on the tunnel line in response to information on a length of the round and the shape of the tunnel line over the section of the round, directing the drilling pattern such that it points from the start point to the end point, and performing coordinate system transformations, taking into account the determined direction of the drilling pattern, wherein the tunnel line is predetermined and the procedures further comprise using the predetermined tunnel line to determine a direction of each of a plurality of successive rounds.

19. A method of determining directions of tunnel coordinate systems, the method comprising:

downloading into at least one control unit a tunnel line of a tunnel to be excavated, the tunnel line being determined in a first coordinate system;

arranging, in the control unit, a second coordinate system at a drilling site such that one of its axes points in a drilling direction;

connecting the coordinate systems with one another;

determining a shape of the tunnel line over a section of a next round to be drilled in response to information on a length of the round;

arranging an origin of the second coordinate system on the tunnel line and determining it as a start point;

determining a distance corresponding with the length of the round to be drilled, starting from the start point, and positioning an end point of the round at the particular location on the tunnel line;

directing the second coordinate system such that one of its axes points from the start point to the end point; and performing coordinate system transformations from the first coordinate system to the second coordinate system, taking into account the determined direction of the second coordinate system, wherein the tunnel line is predetermined and the method further comprises using the predetermined tunnel line to determine a direction of each of a plurality of successive rounds.

20. A method of determining a direction of a drilling pattern, the method comprising:

downloading into a control unit a tunnel line of a tunnel to be excavated, the tunnel line being determined in a project coordinate system of a tunnel worksite;

downloading into the control unit a drilling pattern determining at least a navigation plane and a coordinate system of the drilling pattern;

determining a drilling site for the control unit and arranging a local coordinate system at the drilling site such that one of its axes points in a drilling direction;

positioning the navigation plane of the drilling pattern at the drilling site;

positioning a rock drilling rig at the drilling site and connecting the coordinate systems with one another by navigation;

performing necessary coordinate system transformations from the project coordinate system to the coordinate system of the drilling pattern;

communicating a length of a round to be drilled to the control unit;

determining a shape of the tunnel line over a section of a next round to be drilled;

arranging a start point of the drilling pattern on the tunnel line;

determining a distance corresponding with the length of the round to be drilled, starting from the start point, and positioning an end point of the round at the particular location of the tunnel line;

directing the drilling pattern such that it points from the start point to the end point; and performing coordinate system transformations, taking into account the determined direction of the drilling pattern, and calculating coordinates and directions for holes according to the drilling pattern for drilling, wherein the tunnel line is predetermined and the method further comprises determining the tunnel line by means of a curve table comprising a plurality of points via which the tunnel line passes.

21. A method of determining a direction of a drilling pattern, the method comprising:

downloading into a control unit a tunnel line of a tunnel to be excavated, the tunnel line being determined in a project coordinate system of a tunnel worksite;

downloading into the control unit a drilling pattern determining at least a navigation plane and a coordinate system of the drilling pattern;

determining a drilling site for the control unit and arranging a local coordinate system at the drilling site such that one of its axes points in a drilling direction;

positioning the navigation plane of the drilling pattern at the drilling site;

positioning a rock drilling rig at the drilling site and connecting the coordinate systems with one another by navigation;

performing necessary coordinate system transformations from the project coordinate system to the coordinate system of the drilling pattern;

communicating a length of a round to be drilled to the control unit;

determining a shape of the tunnel line over a section of a next round to be drilled;

arranging a start point of the drilling pattern on the tunnel line;

determining a distance corresponding with the length of the round to be drilled, starting from the start point, and positioning an end point of the round at the particular location of the tunnel line;

directing the drilling pattern such that it points from the start point to the end point; and performing coordinate system transformations, taking into account the determined direction of the drilling pattern, and calculating coordinates and directions for holes according to the drilling pattern for drilling, wherein the tunnel line is predetermined and the method further comprises determining in advance a curvature of the tunnel line using at least one mathematical function.

* * * * *